US008490747B2

(12) United States Patent
Winslow et al.

(10) Patent No.: US 8,490,747 B2
(45) Date of Patent: Jul. 23, 2013

(54) TELESCOPING PROJECT TRAY

(75) Inventors: David A. Winslow, Hermitage, PA (US); Yick B. Shum, Roselle, IL (US); John J. Dylik, La Grange, IL (US); Marcus Burzynski, Glendale Heights, IL (US)

(73) Assignee: Werner Co., Greenville, PA (US)

( * ) Notice: Subject to any disclaimer, the term of this patent is extended or adjusted under 35 U.S.C. 154(b) by 1292 days.

(21) Appl. No.: 11/480,046

(22) Filed: Jun. 30, 2006

(65) Prior Publication Data

US 2008/0000722 A1 Jan. 3, 2008

(51) Int. Cl.
*E06C 1/00* (2006.01)

(52) U.S. Cl.
USPC ..... 182/129; 182/118; 182/119

(58) Field of Classification Search
USPC ..... 182/129, 115, 17, 186.6, 186.9, 222, 182/223, 69.4, 69.6, 119, 132, 118
See application file for complete search history.

(56) References Cited

U.S. PATENT DOCUMENTS

| | | | | | |
|---|---|---|---|---|---|
| 656,946 | A * | 8/1900 | Corduan | 182/106 |
| 2,882,100 | A * | 4/1959 | Bank | 182/129 |
| 2,923,373 | A * | 2/1960 | Ledgerwood | 182/102 |
| 3,017,968 | A * | 1/1962 | McMahon | 182/141 |
| 3,028,928 | A * | 4/1962 | Jucuiano | 182/178.1 |
| 3,065,982 | A * | 11/1962 | Dodd | 403/105 |
| 3,139,154 | A * | 6/1964 | Ewald | 182/106 |
| 3,490,558 | A * | 1/1970 | Foley | 182/103 |
| 3,656,269 | A * | 4/1972 | Witschel et al. | 52/638 |
| 3,934,676 | A * | 1/1976 | Rice | 182/182.3 |
| 4,145,044 | A * | 3/1979 | Wilson et al. | 473/483 |
| 5,072,955 | A * | 12/1991 | Holland et al. | 280/32.5 |
| 5,086,875 | A * | 2/1992 | Shreve, III | 182/152 |
| 5,120,013 | A * | 6/1992 | Sweeney | 248/238 |
| 5,158,023 | A * | 10/1992 | Allen | 108/42 |
| 5,397,207 | A * | 3/1995 | Arellano et al. | 414/11 |
| 5,555,954 | A * | 9/1996 | Swiderski | 182/152 |
| 5,584,357 | A * | 12/1996 | Gugel et al. | 182/129 |
| 5,622,463 | A * | 4/1997 | Testa | 409/131 |
| 5,740,883 | A * | 4/1998 | Trank | 182/129 |
| 5,908,182 | A * | 6/1999 | Stang et al. | 248/188.2 |
| 6,098,749 | A * | 8/2000 | Enochs | 182/129 |
| 6,220,389 | B1 * | 4/2001 | Krause | 182/23 |
| D444,574 | S * | 7/2001 | Gibson et al. | D25/65 |
| 6,902,034 | B2 * | 6/2005 | Gibson et al. | 182/129 |
| 6,932,194 | B1 * | 8/2005 | Chipman | 182/113 |
| 2003/0178253 | A1 * | 9/2003 | Tatge et al. | 182/132 |
| 2004/0245045 | A1 * | 12/2004 | Shai | 182/17 |

* cited by examiner

*Primary Examiner* — Alvin Chin Shue
*Assistant Examiner* — Daniel Cahn
(74) *Attorney, Agent, or Firm* — Ansel M. Schwartz

(57) ABSTRACT

A scaffold includes a frame assembly. The scaffold includes planks that are disposed on the frame assembly. The scaffold includes wheels attached to the frame assembly on which the frame assembly rolls. The scaffold includes a project tray which extends from the frame assembly. The scaffold includes a telescoping tube assembly that is mounted to the frame assembly and on which the tray is mounted. A method for using a scaffold. The method includes the steps of placing a telescoping tray assembly at a desired height relative to a frame assembly having planks disposed on it by moving the tray assembly which extends from the frame assembly. There is the step of locking the tray assembly at the desired height to the frame assembly.

4 Claims, 5 Drawing Sheets

TELESCOPING PROJECT TRAY

FIELD OF THE INVENTION

The present invention is related to a scaffold having a telescoping tray assembly. More specifically, the present invention is related to a scaffold having a telescoping tray assembly that extends from inside a frame assembly.

BACKGROUND OF THE INVENTION

The mini scaffold is designed and targeted to users working on long-duration projects where moving a lot or working at multiple heights is important. These types of mini rolling scaffolds allow users to set up a work surface with the flexibility to set planks at varying heights and also move to different locations around the work environment as needed. They are particularly useful for drywall installers and finishers, dropped-ceiling installers, drapery hangers and general DIY (do-it-yourself) users. In addition to having multiple standing height capability, the Werner mini rolling scaffold incorporates a multiple height project tray that acts as an additional work surface and means of storing supplies and tools used on the job The telescoping project tray allows users to have the ability to adjust the tray to specific heights for both convenience and safety. By providing an additional work surface at adjustable locations allows tools and supplies to be more easily accessed and stored and also prevents having to climb down from the scaffold to retrieve additional tools when needed.

BRIEF SUMMARY OF THE INVENTION

The present invention pertains to a scaffold. The scaffold comprises a frame assembly. The scaffold comprises planks that are disposed on the frame assembly. The scaffold comprises wheels attached to the frame assembly on which the frame assembly rolls. The scaffold comprises a project tray which extends from the frame assembly. The scaffold comprises a telescoping tube assembly that is mounted to the frame assembly and on which the tray is mounted.

The present invention pertains to a method for using a scaffold. The method comprises the steps of placing a telescoping tray assembly at a desired height relative to a frame assembly having planks disposed on it by moving the tray assembly which extends from the frame assembly. There is the step of locking the tray assembly at the desired height to the frame assembly.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
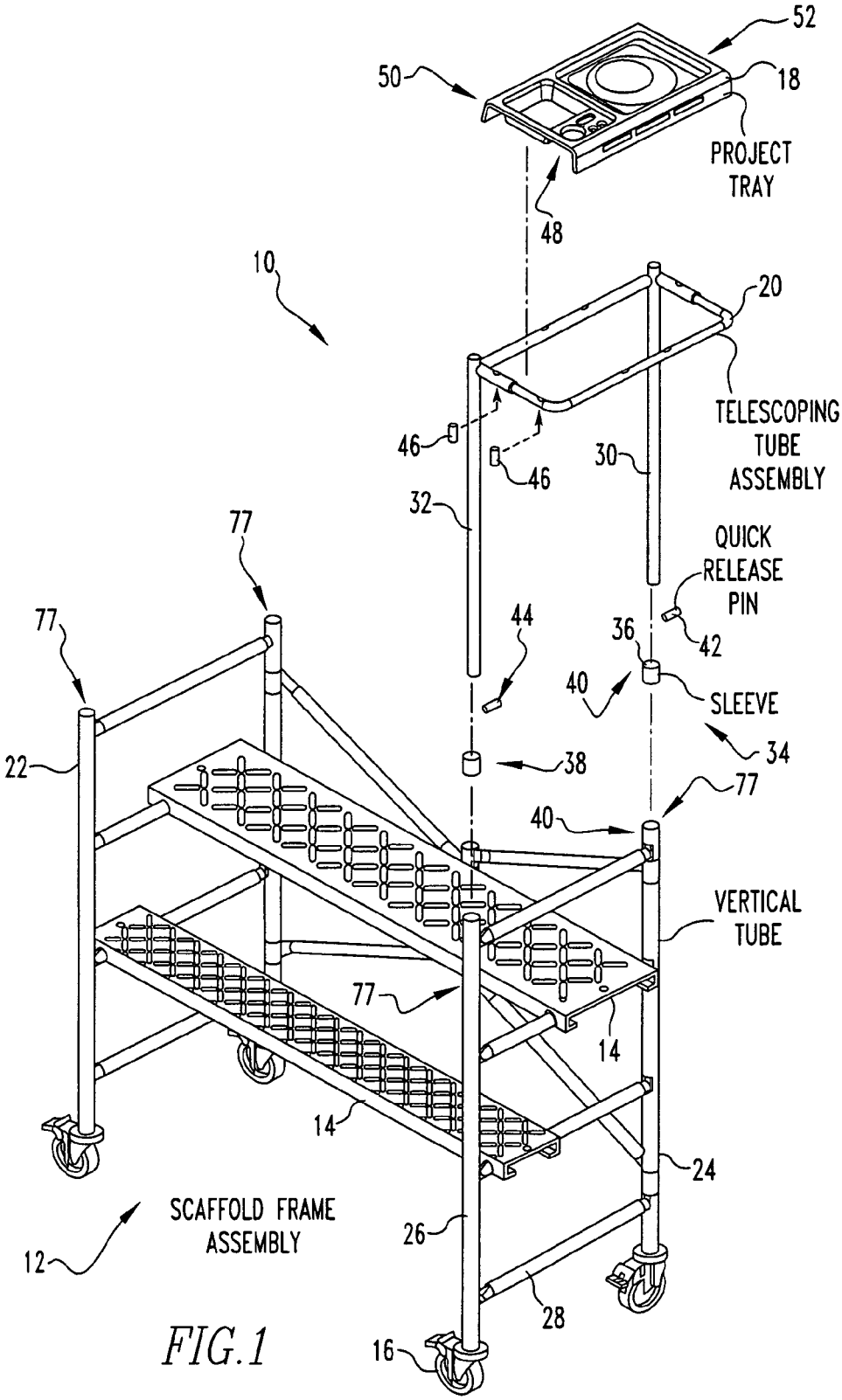
FIG. 1 is a perspective exploded view of the scaffold of the present invention.
Figure 4:
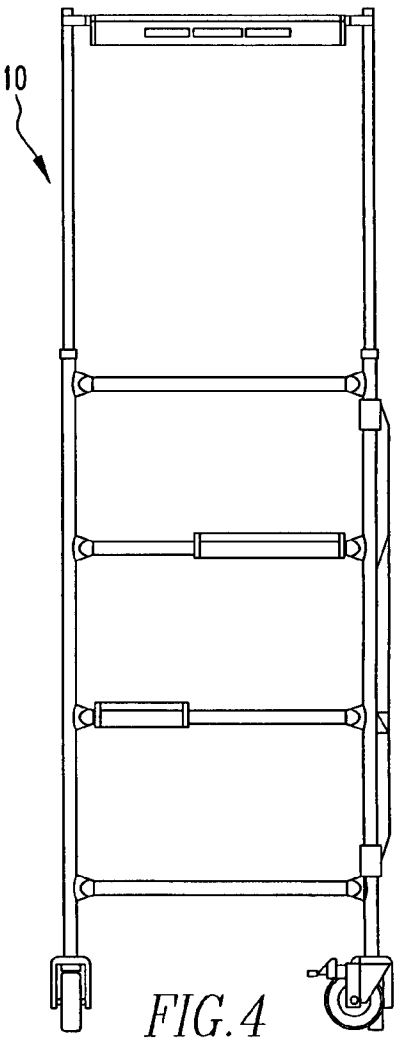
FIGS. 2-4 are side views of the scaffold with the tray at different heights.
Figure 3:
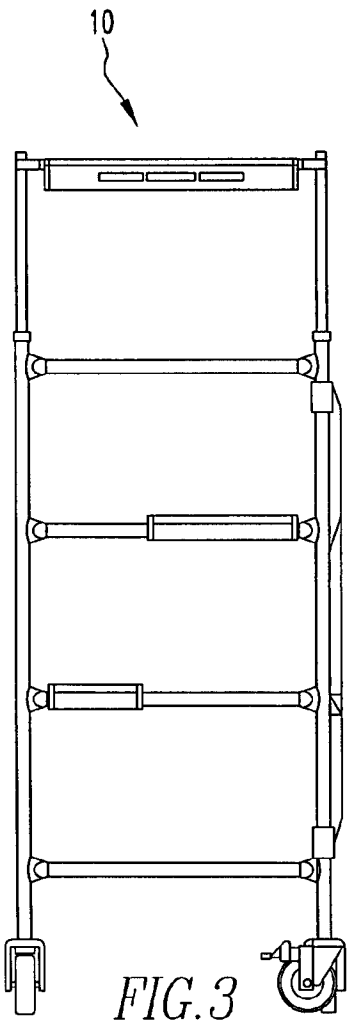
Figure 2:
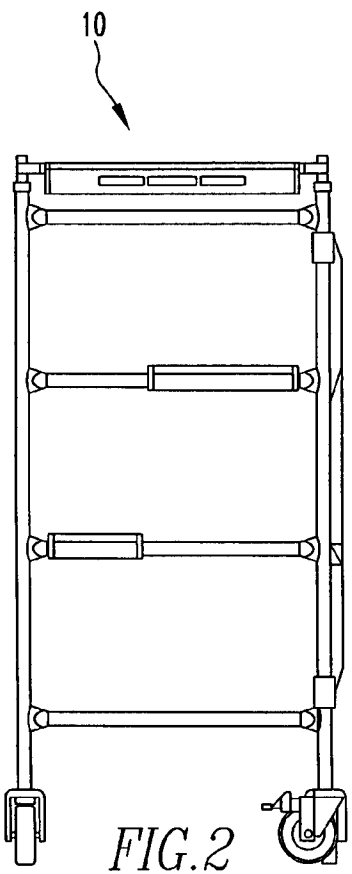
Figure 5:
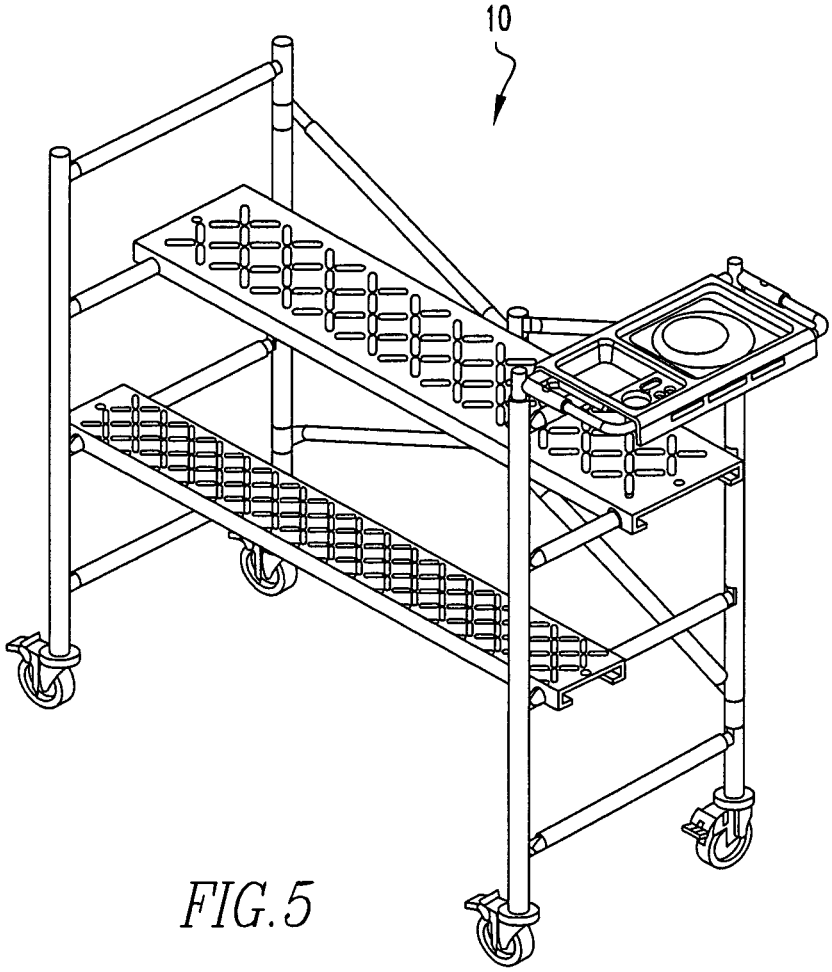
FIGS. 5-7 are perspective views of the scaffold with the tray at different heights.
Figure 6:
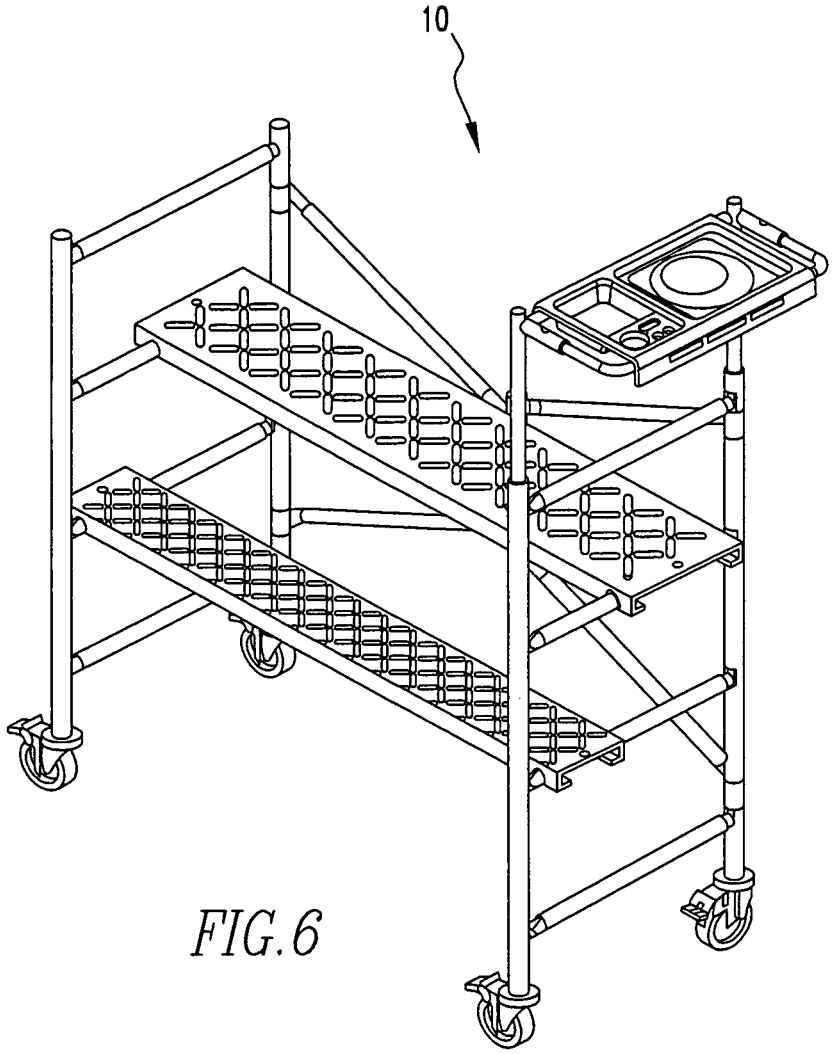
Figure 7:
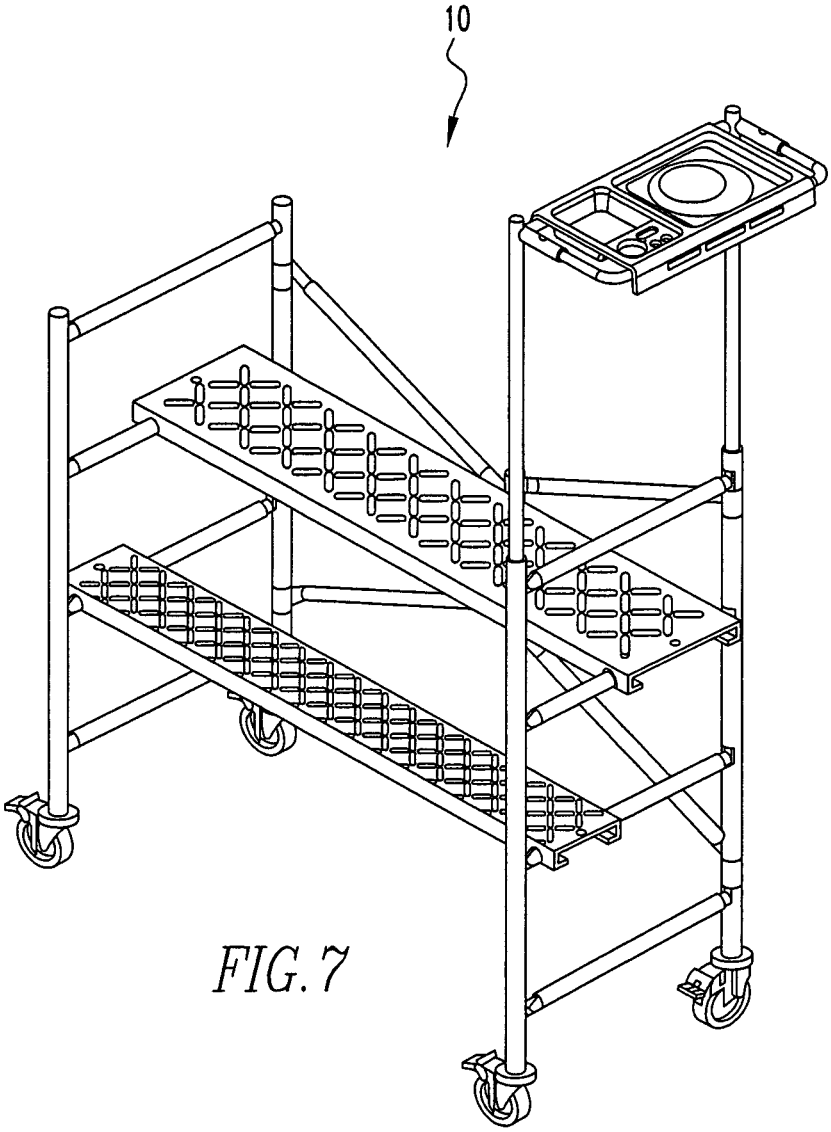

Referring now to the drawings wherein like reference numerals refer to similar or identical parts throughout the several views, and more specifically to FIG. 1 thereof, there is shown a frame assembly 12. The scaffold 10 comprises planks 14 that are disposed on the frame assembly 12. The scaffold 10 comprises wheels 16 attached to the frame assembly 12 on which the frame assembly 12 rolls. The scaffold 10 comprises a project tray 18 which extends from the frame assembly 12. The scaffold 10 comprises a telescoping tube assembly 20 that is mounted to the frame assembly 12 and on which the tray 18 is mounted.

Preferably, the tube assembly 20 is mounted inside the frame assembly 12. The tube assembly 20 preferably includes an engaging assembly 34 which releasably locks the tube assembly 20 with the frame assembly 12 so the tube assembly 20 can be secured to the frame assembly 12 at a desired height. Preferably, the frame assembly 12 has at least four vertical tubes 22 including at least a first hollow vertical tube 24 and a second hollow vertical tube 26, and a plurality of horizontal bars 28 that are supported by the four vertical tubes 22 and on which the planks 14 are disposed. The tube assembly 20 preferably includes a first telescoping tube 30 that fits inside the first vertical tube 24 and a second telescoping tube 32 that fits inside the second vertical tube 26.

Preferably, the engaging assembly 34 includes a first sleeve 36 that is fitted to the top of the first vertical tube 24 and a second sleeve 38 that is fitted to the top of the second vertical tube 26 and through which the first telescoping tube 30 and the second telescoping tube 32 extend through, respectively, into the first vertical tube 24 and the second vertical tube 26, respectively. The first and second vertical tubes 24, 26, and the first and second sleeves 36, 38 preferably each have holes 40 that align with each other, respectively. Preferably, the engaging assembly 34 includes a first quick release pin 42 and a second quick release pin 44 that extend through the holes 40 of the first vertical tube 24 and the first sleeve 36, and the second vertical tube 26 and the second sleeve 38, respectively, to lock the tube assembly 20 to the frame assembly 12.

The tray 18 is preferably secured to the tube assembly 20 with fasteners 46. Preferably, the first and second sleeve 36, 38 tubes each have a plurality of holes 40 to vary the height that the tray 18 assembly is locked to the frame assembly 12, as shown in FIGS. 2-7. The tray 18 preferably includes tool holes 48 for storing tools. Preferably, the tray 18 includes a bin 50 for holding parts. The tray 18 preferably includes a depression 52 for holding a paint container.

The present invention pertains to a method for using a scaffold 10. The method comprises the steps of placing a telescoping tray 18 assembly at a desired height relative to a frame assembly 12 having planks 14 disposed on it by moving the tray 18 assembly which extends from the frame assembly 12. There is the step of locking the tray 18 assembly at the desired height to the frame assembly 12. Preferably, the placing step includes the step of sliding a first telescoping tube 30 and a second telescoping tube 32 of the tray 18 assembly disposed inside a first hollow vertical tube 24 and a second hollow vertical tube 26 of the frame assembly 12, respectively, to a desired height.

In the operation of the invention, the mini-rolling scaffold 10 is comprised of a steel scaffold frame assembly 12, steel planks 14, durable plastic wheels 16 and project tray 18. The scaffold 10 frame assembly 12 is constructed of 1" OD steel tubes with vertical, horizontal and diagonal tubes welded together to form the structure. The four vertical tubes 22 at each corner 77 of the frame support the horizontal bars 28 that the standing planks 14 rest upon. The planks 14 are made of steel and all steel parts are powder coated or painted for protection against the environment.

The plastic project tray 18 is mounted to a welded steel telescoping tube assembly 20 that fits inside the vertical tubes 22 of the scaffold 10 frame assembly 12. This ingenious design permits the ease of telescoping the tray 18 without taking up any additional space on the outside of frame assembly 12. In addition, the telescoping tube slides through a fitted plastic sleeve for smooth operation of adjustment and added stability of the tube interface.

The project tray 18 is secured to the telescoping tube with use of standard fasteners 46 and the telescoping tube is attached to the vertical tube using quick release pins.

The elements of the design are listed in more detail below. The unique feature of the telescoping tray 18 is the fact that the telescoping tube fits inside the vertical tube of the scaffold 10 frame assembly 12 to provide a simple, convenient and effective method of adjusting the tray 18 to multiple heights. The number of heights is not limited to the current offering which is three (3) locations. An alternative slip-collar method permits infinite adjustment between the lowest and highest connection points.

Project Tray 18—Molded plastic work surface incorporates holes 40 for storing a drill, screwdriver, paint brush or similar tools. Also integrates a deep recessed pocket for a parts bin 50 and circular and rectangular depressions 52 for holding paint containers.

Sleeve—Plastic sleeve that fits inside of vertical tubes 22 to accommodate the telescoping tube assembly 20. Also incorporates a hole for quick release pin clearance.

Telescoping Tube Assembly 20—Steel frame once bolted together, forms a complete project tray 18 assembly. Diameter of tube is smaller than the diameter of sleeve that fits into vertical tube of scaffold 10 frame assembly 12.

Quick Release Pin—Steel pin designed for easy release and permits telescoping tube to slide within the vertical tube. Once project tray 18 is set to desired location, the quick release pin is re-installed to secure the tray 18 in-place.

Scaffold 10 Frame Assembly 12—Tubular steel frame welded together to form the overall structure of the mini-scaffold. It incorporates vertical, horizontal, and diagonal tubes to create a self supporting frame.

Planks 14—Formed steel planks 14 provide means of standing on the scaffold frame. Planks 14 are stamped with textured surface to provide slip resistance while working.

The preferred method for using the telescoping Project Tray 18 assembly is as follows:

1. Place the mini rolling scaffold 10 near the work surface of the wall, ceiling or general environment
2. Set planks 14 at desired height locations on the scaffold 10 frame assembly 12 keeping them parallel to floor.
3. Lock all four casters.
4. Remove release pins from telescoping and vertical tubes 22.
5. Slide telescoping tube with project tray 18 attached to desired height.
6. Re-Install release pins to secure telescoping tube to vertical tube of scaffold 10 frame assembly.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A scaffold comprising:

a frame assembly having a first vertical hollow tube at a first corner of the assembly, a second vertical hollow tube at a second corner of the assembly, a third vertical tube at a third corner of the assembly and a fourth vertical tube at a fourth corner of the assembly; the first and second vertical tubes have a first set of horizontal tubes between them and the third and fourth vertical tubes have a second set of horizontal tubes between them; and diagonal tubes extending between the second vertical tube and the third vertical tube; the first, second, third and fourth corners defining a rectangle;

a movable plank that is disposed on a horizontal tube of the first set of horizontal tubes and a horizontal tube of the second set of horizontal tubes of the frame assembly inside the rectangle;

a wheel attached to a bottom of each of the first, second, third and fourth vertical tubes of the frame assembly on which the frame assembly is capable of rolling;

a plastic project tray, the tray includes holes for storing tools;

a telescoping tube assembly that is mounted inside the first and second vertical tubes of the frame assembly only, the tray is mounted to the telescoping tube assembly, the tube assembly includes a first telescoping tube that fits inside the first vertical tube and a second telescoping tube that fits inside the second vertical tube, the tube assembly able to be moved up or down relative to the first and second vertical tubes to a desired height; and an engagement assembly which releasably locks the tube assembly with the frame assembly so the tube assembly can be secured to the frame assembly at the desired height, the engagement assembly includes a first plastic sleeve that is fitted to the top of the first vertical tube, and a second plastic sleeve that is fitted to the top of the second vertical tube, and through which the first telescoping tube and the second telescoping tube extend through, respectively, into the first vertical tube and the second vertical tube, respectively; the first and second vertical tubes, and the first and second sleeves each have holes that align with each other, respectively; the engagement assembly includes a first quick release pin and a second quick release pin that extend through the holes of the first vertical tube and the first sleeve, and the second vertical tube and the second sleeve, respectively, to lock the tube assembly to the frame assembly.

2. A scaffold as described in claim 1 wherein the tray is secured to the tube assembly with fasteners.

3. A scaffold as described in claim 2 wherein the tray includes a bin for holding parts.

4. A scaffold as described in claim 3 wherein the tray includes a depression for holding a paint container.

* * * * *